United States Patent [19]

Knight et al.

[11] 4,161,802

[45] Jul. 24, 1979

[54] DRAPERY AND DRAPERY PLEAT CLEANING TOOL HEAD

[76] Inventors: Arlen M. Knight, 1141 N. Patterson; William R. Hachtmann, 5072 Walnut Park Dr., both of Santa Barbara, Calif. 93111

[21] Appl. No.: 894,703

[22] Filed: Apr. 10, 1978

[51] Int. Cl.[2] ..... A47L 9/02

[52] U.S. Cl. ..... 15/331; 15/322; 15/394; 15/395; 15/415 R

[58] Field of Search ..... 15/322, 328, 337, 338, 15/394, 395, 397, 415, 420, 422, 331

[56] References Cited

U.S. PATENT DOCUMENTS

| | | | |
|---|---|---|---|
| 1,431,943 | 10/1922 | McGee | 15/397 X |
| 3,009,188 | 11/1961 | Martin | 15/415 X |
| 3,169,843 | 2/1965 | Campbell | 15/420 X |
| 3,771,193 | 11/1973 | Hageal | 15/397 |

*Primary Examiner*—Christopher K. Moore

*Attorney, Agent, or Firm*—Ralph B. Pastoriza

[57] ABSTRACT

The hand-held tool head assembly comprises a housing connected to a flexible vacuum hose to a source. The housing has an elongated front wall with a plurality of openings defining a suction surface. An intermediate portion of this wall is cut-out and formed with a receiving structure for receiving inserts. A first insert has a front wall portion with openings so that when it is received in the cut-out portion it is flush with the surface openings on either side of the cut-out to provide a continuous elongated cleaning surface. A second insert is arranged to be substituted for the first insert and has a front undulating suction surface defined by transverse fins with channels therebetween, the side walls of the fins, the front tips of the fins and the floors of the channels all having openings communicating with the interior of the tool head to provide suction surfaces for drapery pleats received within the channels. By use of the second insert, the tool head can rapidly be converted to provide a cleaning device for drapery pleats.

6 Claims, 7 Drawing Figures

DRAPERY AND DRAPERY PLEAT CLEANING TOOL HEAD

This invention relates generally to hand-held cleaning heads and more particularly to a drapery and drapery pleat cleaning tool head assembly for use with a cleaning machine normally including a recovery tank and a solution dispensing tank.

BACKGROUND OF THE INVENTION

Hand-held drapery cleaning tool heads are known in the art and generally comprise a fan-shaped housing with an elongated suction surface at the wide front end of the housing and a rear opening at the rear narrow portion of the housing for connection to a recovery tank in a cleaning machine by way of a vacuum hose. It is also known to provide in the cleaning machine a cleaning fluid solution dispensing tank which will provide cleaning fluid under pressure through an inlet fluid line from the dispensing tank to the cleaning head.

In our copending patent application Ser. No. 794,352 filed May 6, 1977, entitled DRAPERY CLEANING TOOL HEAD, now abandoned, there is disclosed a specially designed hand-held drapery cleaning head incorporating improved nozzle means for spraying of drapery areas immediately prior to moving the suction surface of the head over the sprayed areas. The elongated suction surface itself includes two off-set parallel rows of openings communicating with the interior of the head for providing suction or vacuum to the suction surface. Offsetting of the parallel rows of openings assures that the entire surface of the drapery material engaged by the elongated head will be cleaned or subject to the suction when the tool is moved downwardly; that is, at right angles to the direction of elongation of the head.

While the above-described tool and other tools of the prior art which might provide only a vacuum or suction for a cleaning head will function to clean the depending portions of a drape, they are very awkward to use in cleaning the drape pleats normally formed in sets along the upper margin of the drape. These pleats or folds simply cannot be cleaned with presently available heads.

As a consequence of the foregoing, it is usually necessary to remove the cleaning head and insert a modified head having a single narrow elongated slot which can be urged between the folds of the pleats and manipulated in an attempt to clean the pleat surfaces.

Not only is the foregoing operation time-consuming in requiring disconnection of the vacuum hose line and in the event spray fluid is employed, the fluid line, but also the substituted head must be individually inserted between the various folds of each of the pleats to assure proper cleaning.

BRIEF DESCRIPTION OF THE PRESENT INVENTION

Bearing the foregoing in mind, the present invention contemplates an improved drapery cleaning hand-held tool head assembly for use with a vacuum hose uniquely designed in such a manner that the same head can be utilized for cleaning sets of pleats without having to disconnect the vacuum hose, fluid line if any, and substitute an entirely new head, all to the end that thorough cleaning of draperies as well as drapery pleats can be carried out far more efficiently than heretofore.

More particularly, in accord with the present invention, the tool head assembly includes housing having a front wall with a plurality of openings to define a suction surface, the front wall having a cut-out. An insert is received in this cut-out and has an undulating shape defining fins with channels therebetween. The side walls of the fins are provided with suction openings to define suction surface portions so that the pleated portions of drapes may be received in the channels between the fins to enable cleaning of the pleat surfaces by the tool head.

In the preferred embodiment of the assembly of this invention, a further insert is provided with a normally designed front wall surface having openings such that when it is inserted in the cut-out as a substitute for the first mentioned insert, it is flush with the front wall suction surfaces on either side of the cut-out so that a continuous elongated suction surface is provided for normal drapery cleaning operations.

Thus, considered in its broadest aspect, the front wall essentially has means for mounting in operative position any one of a plurality of inserts having different work surface configurations for cleaning differently configured work surfaces.

With the foregoing arrangement, it is very simple for an operator to simply remove one insert and insert another for the specific job of cleaning the folded surfaces of drapery pleats.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
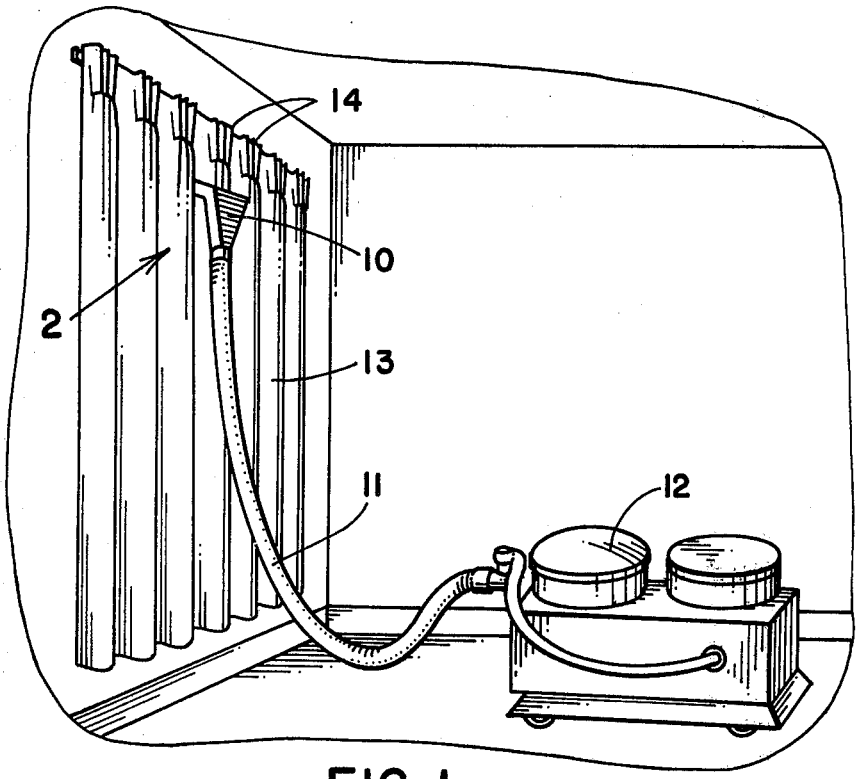
FIG. 1 is a fragmentary perspective view of a room having window drapes with the drapery and drapery pleat cleaning tool head shown in operative position connected through a suitable vacuum hose to cleaning apparatus in the room.

Referring first to FIG. 1, the drapery and drapery pleat cleaning tool head is shown at 10 connected to a vacuum hose 11 extending from appropriate cleaning equipment including a recovery tank 12. The tool head 10 is arranged to be hand-held and moved up and down along the main surface areas of drapery material such as indicated at 13. Also, as will become clearer as the description proceeds, the tool head 10 is designed in such a manner that it can be used for cleaning the pleated portions of the drapes normally provided in sets of three folds or pleats distributed along the top margin of the drapes as indicated at 14.

There may also be included in the cleaning apparatus incorporating the recovery tank 12 an appropriate fluid dispensing tank and fluid line leading up to the hand held head. With this arrangement, nozzles are provided as a part of the head for spraying cleaning fluid on the drapes immediately below the front suction surface of the head so that the head will pass over the fluid treated portions when cleaning the drapes. Such specific type arrangement is illustrated in more detail in our above-referred to copending patent application. However, since the present cleaning head invention can be used with either a simple vacuum type cleaning head without any fluid dispensing nozzles or alternatively with a head having dispensing nozzles, the fluid dispensing nozzles themselves are not shown.

Figure 2:
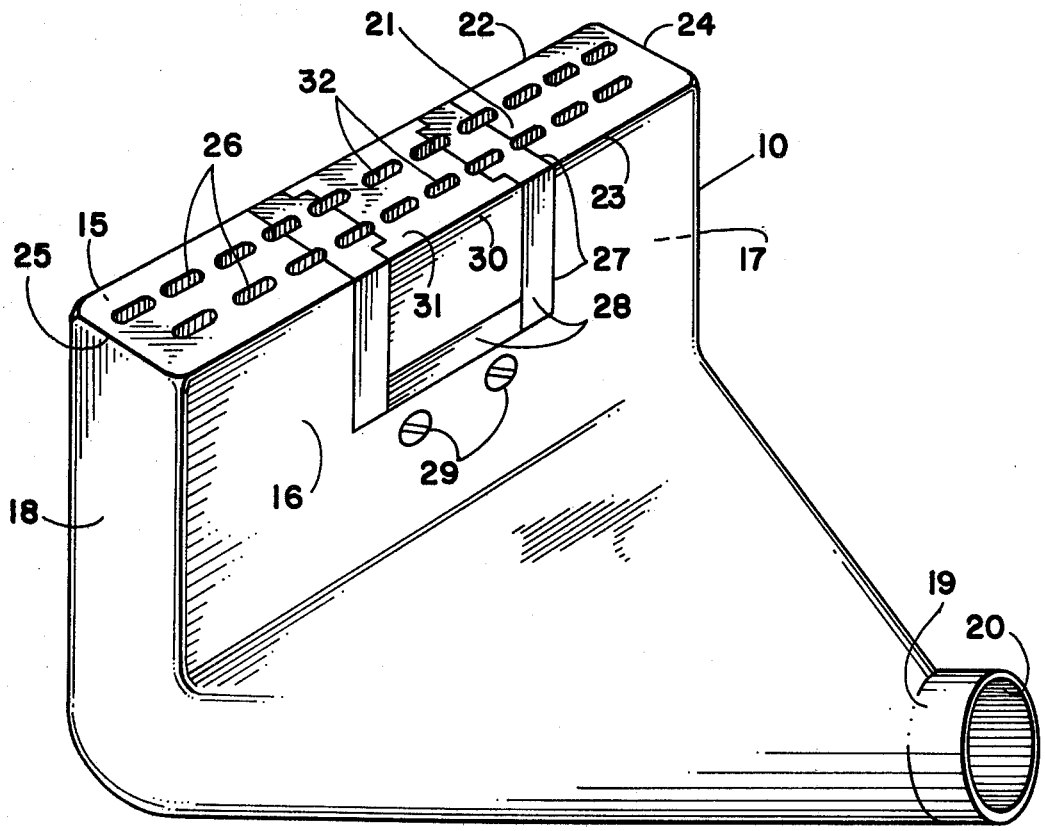
FIG. 2 is a greatly enlarged underside perspective view of the cleaning head assembly itself looking in the direction of the arrow 2 of FIG. 1.

Referring now to the underside view of the cleaning head of FIG. 1 as illustrated in FIG. 2, the head 10 basically includes, in combination a housing comprised of wide front ended top and bottom walls 15 and 16 spaced relatively close together with left and right side walls 17 and 18 converging towards each other in a rearward direction to merge with narrowed rear end portions of the top and bottom walls into a cylindrical portion 19. This rear cylindrical portion defines a rear end opening 20 for connection to a vacuum hose such as the hose 11 of FIG. 1. A front wall 21 extends between the front end edges 22 and 23 of the top and bottom walls respectively and the front end edges 24 and 25 of the left and right side walls respectively. The reference to top and bottom walls and left and right side walls is taken with respect to the orientation of the cleaning head illustrated in FIG. 1. Since this head is illustrated inverted in FIG. 2, the top and bottom and left and right references are reversed.

The elongated front wall 21 as shown includes a plurality of openings 26 which, in the particular embodiment illustrated may comprise offset parallel rows of openings having elongated dimensions in the direction of elongation of the front wall 21 greater than the spacing between successive openings so that the openings in one row will overlap the openings in the other. While the openings may be circular, such as illustrated in our heretofore referred to copending application, they could alternatively be elongated or slot shaped as illustrated in FIG. 2. In either instance, there are provided a sufficient number of small openings so that proper suction can be provided essentially over the entire surface without danger of drawing in or sucking into the head the relatively thin drapery material. The offsetting of the parallel rows will assure that the entire surface engaged by the elongated front suction surface of the head will be exposed to suction when the head is moved downwardly as shown in FIG. 1; that is, in a direction at right angles to the direction of elongation.

Still referring to FIG. 2, it will be noted that a portion of the elongated front wall 21 and corresponding extending portions of the top and bottom walls 15 and 16 intermediate the front ends 24 and 25 of the side walls define a cut out 27. An insert receiving means 28 is secured in this cut out as by screws 29.

The insert receiving means 28, in turn, is arranged to receive a first insert 30 having a front wall portion 31 flush with the elongated front wall 21 on either side of the cut out 27. This front wall 31 of the insert is provided with openings 32 positioned to provide continuity with the openings 26 in the front wall 21 so that when the insert 30 is in position, there is defined a continuous suction surface between the front ends 24 and 25 of the left and right side walls for efficient cleaning of depending drapery material.

With respect to the foregoing, it should be understood that the insert receiving means 28 will also include openings or partial openings for registering with other partial openings to complete the described continuity of the openings so that with the insert 30 in place, the front suction surface will operate as a normal drapery cleaning tool head similar to that described in our copending patent application.

Figure 3:
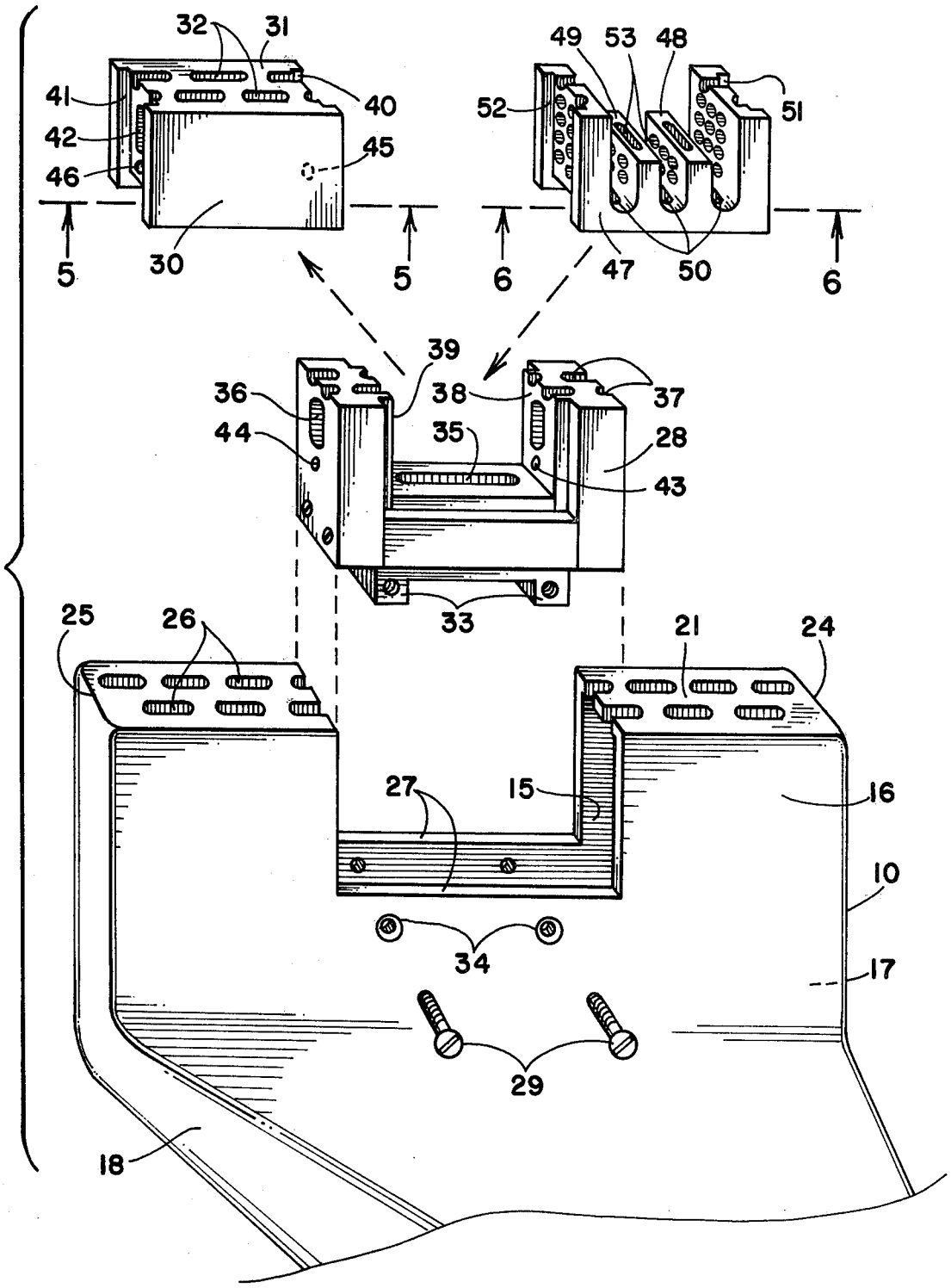
FIG. 3 is a fragmentary perspective view similar to FIG. 2 illustrating in exploded view various components making up the tool head assembly of this invention.

Referring now to FIG. 3, the significance of the insert receiving means 28 in the cut out 27 for receiving the insert 30 as described in FIG. 2 will be understood. In FIG. 3, corresponding parts are designated by the same numerals utilized in FIG. 2.

Thus, as shown in FIG. 3, the insert receiving means 28 is shown exploded above the cut-out 27. Appropriate feet 33 are formed on the bottom of this insert receiving means with appropriate screw holes for registering with screw holes 34 in the top and bottom walls 15 and 16 of the head. The fastening screws 29 described in FIG. 2 are shown exploded in FIG. 3 and it will be understood that the insert receiving means 28 when nested within the cut out 27 is permanently secured in place by these screws.

As further shown in FIG. 3, the insert receiving means 28 includes a bottom opening 35 and side walls openings such as indicated at 36 for communication with the interior of the head 10. In addition, there are provided necessary top openings or portions of openings such as indicated at 37 to complete the continuity of the various openings 26 when the insert receiving means 28 is secured in place.

Still referring to the insert receiving structure 28, it will be noted that the opposing walls include keys 38 and 39, these keys cooperating with appropriate key ways in the first insert 30 described in FIG. 2 and as will now be described in FIG. 3.

Referring to the upper left of FIG. 3 there is shown in exploded view the first insert 30 with appropriate key ways 40 and 41 formed on opposite walls and dimensioned to receive the keys 38 and 39 when the insert is inserted within the insert receiving structure 28. These opposite side walls further include openings such as indicated at 42 for communication with the opening 36, for example, in the insert receiving structure 28 so that vacuum or suction will be communicated to the interior of the insert 30. The top openings 32 in the top front wall 31 of this insert 30 described heretofore, communicate with the side openings such as 42 and 36 in the insert and insert receiving means respectively so as to be subject to suction in the head 10.

In order to properly index or hold the first insert 30 within the insert receiving means 28, the keys and key ways are provided respectively with spring biased balls such as indicated at 43 and 44 for the insert receiving means 28, and detents such as indicated at 45 and 46 for the insert 30. The arrangement is such that when the insert 30 is fully inserted in the insert receiving means 28 so that the front surface 31 is flush with the elongated front surface 21 of the head, the spring biased balls 43 and 44 will be received in the detents 45 and 46 and thus hold the insert in proper position. The spring pressure of the spring biased balls is such that the insert can easily be manually removed and inserted. The keys and key ways on the other hand will provide a locking of the insert against lateral movement relative to the portions of the head on either side of the cut-out which is the only direction in which a major resistance force might be encountered by the insert when moving the head in a direction at right angles to the direction of elongation. In other words, very little force is required to retain the insert in the insert receiving means since there is really no force tending to move the insert out of the insert receiving means except that of gravity should the head be turned upside down.

Referring now to the upper right hand portion of FIG. 3 there is illustrated a second insert 47 having an undulating front surface defining transverse fins 48 and 49 defining channels 50 therebetween. Opposite sides of the insert 47 similarly include key ways 51 and 52 dimensioned to match with the keys 38 and 39 of the insert receiving means 28 so that the second insert 47 can readily be substituted for the first insert 30 as indicated schematically by the dashed arrows.

The fins include openings in their side walls as well as front tip openings as indicated by the numeral 53 in FIG. 3, these openings communicating with the openings such as 35 and 36 in the insert receiving means 28 so that they are subject to suction or vacuum within the head 10.

Figure 4:
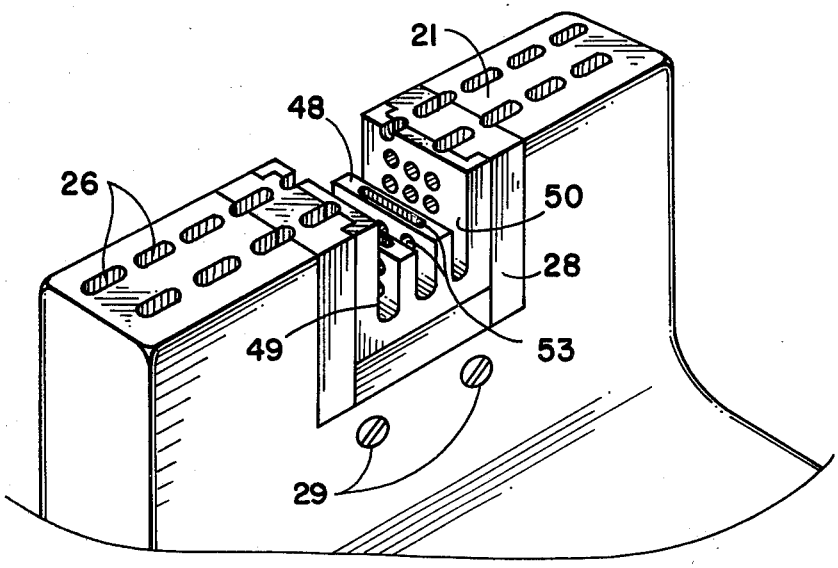
FIG. 4 is a view similar to FIG. 2 illustrating a substituted component in the head for cleaning drapery pleats.

Referring now to FIG. 4, there is shown in fragmentary perspective view the second insert 47 in position within the insert receiving means 28. In this respect, it will be understood that the opposite key ways of the second insert 47 include appropriate detents for cooperating with the spring biased balls in the same manner as the first insert 30 described in FIG. 3.

Figure 5:
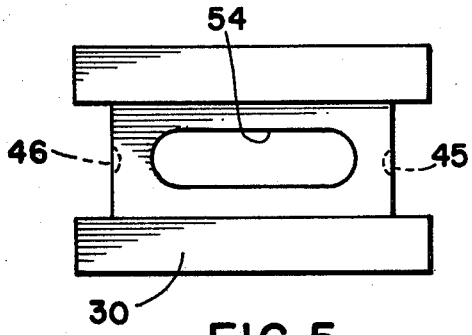
FIG. 5 is a bottom plan view of one of the inserts forming part of the combination of the cleaning head assembly looking in the direction of the arrows 5—5 of FIG. 3.

FIG. 5 shows the underside of the first insert 30 wherein there is disclosed an elongated opening 54 for communication with the opening 35 in the insert receiving means 28 described in FIG. 3. The spring biased ball receiving detents 45 and 46 are also illustrated in dotted lines in FIG. 5 for this first insert.

Figure 6:
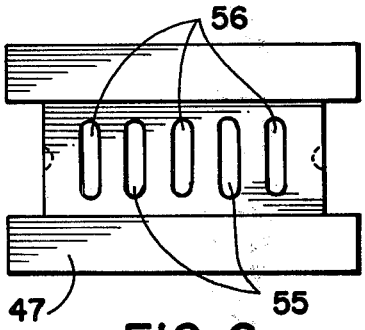
FIG. 6 is an underside plan view of a second insert constituting another component of the head assembly combination looking in the direction of the arrows 6—6 of FIG. 3; and, FIG. 7 is an enlarged fragmentary perspective view illustrating the cleaning head utilized in cleaning drapery pleats in accord with the invention.

FIG. 6 is a bottom view of the second insert 47 wherein there are provided elongated openings 55 which communicate with the front tip openings 53 of the fins 48 and 49 described in FIGS. 3 and 4 and also openings 56 constituting openings in the floors of the channels 50. These openings 55 and 56 in the second insert member will all communicate with the single elongated opening 35 of the insert receiving means 28 described in FIG. 3. Appropriate side openings in the side walls of each of the inserts will also communicate with the side wall openings such as 36 for the insert receiving means 28 as also described heretofore. It will thus be evident that suction surfaces are provided at the front tips as well as the sides of the fins and the floor of the channels and the end walls of the channels.

Figure 7:
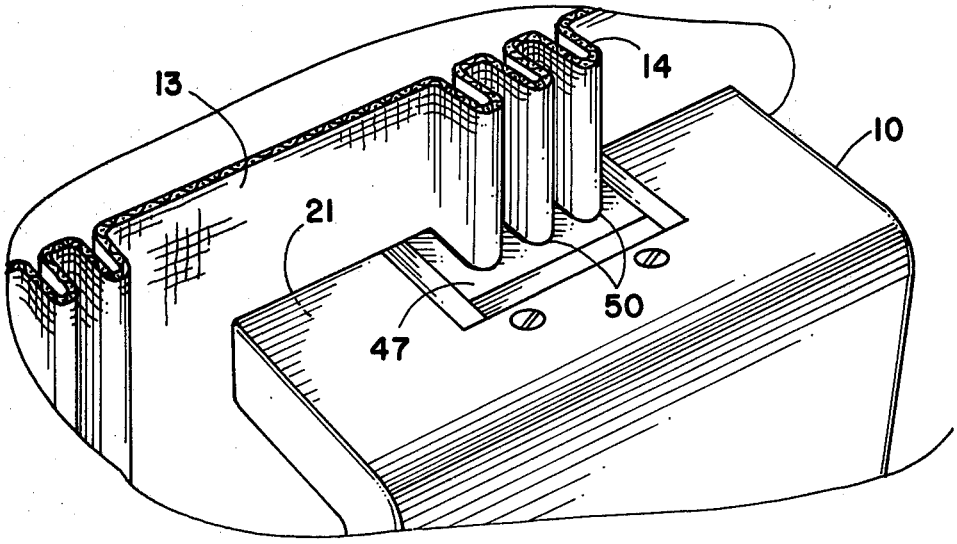

Referring to FIG. 7, there is illustrated the manner in which a set of pleats 14 for the drapes 13 described in FIG. 1 are cleaned, utilizing the second insert 47. As shown, the folds of the pleats are simply respectively individually received in the individual channels 50 there normally being provided three folds or pleats per set. Since the fins extend within the folds of the pleats and have the side openings as well as the front tip openings as described, all surfaces of the pleated portion of the drapes can readily be cleaned by simply moving the head 10 up and down when positioned to engage the pleats as illustrated in FIG. 7.

As will readily be understood, when it is desired to clean the remaining or principal front areas of the drapery material, the second insert 47 can easily be manually removed and the first insert 30 providing the continuous elongated suction surface substituted.

From all of the foregoing, it will thus be evident that the present invention has provided a drapery cleaning tool head assembly incorporating means for enabling the specialized cleaning of drapery pleats without sacrificing the principal use of the cleaning head for cleaning the main drapery surfaces, all without the necessity of disconnecting the vacuum hose and substituting an entirely different type of head.

While the cut out portion of the elongated front wall of the cleaning head is illustrated as constituting about one third of the overall elongated length of the head measured between the front edges 24 and 25 of the side walls, this cut out may vary from between one fifth and one half such dimension. However, the preferred proportion would be about one third as illustrated so that there will be provided the normal front wall suction surfaces for cleaning the drapery material on either side of the sets of pleats as illustrated in FIG. 7. In this respect, the overall elongated length of the suction surface as measured between the front ends of the side walls is preferably greater than the distance between sets of pleats of the draperies to be cleaned so that all of the area of the drapes between the sets of pleats will be cleaned as the head is moved from one set of pleats to the next. In other words, the end portions of the front wall extend more than one half the distance between sets of pleats on either side of the particular pleats being cleaned.

Various changes in the specific construction falling within the scope and spirit of this invention will, of course, occur to those skilled in the art. The drapery and drapery pleat cleaning tool head assembly is therefore not to be thought of as limited to the specific construction set forth for illustrative purposes.

We claim:

1. A drapery and drapery pleat cleaning tool head assembly for connection to a vacuum hose extending from a cleaning machine, said tool head assembly including, in combination:

(a) a housing comprised of wide front ended top and bottom walls spaced relatively close together with left and right side walls converging towards each other in a rearward direction to merge with narrowed rear end portions of said top and bottom walls into a cylindrical portion having a rear end opening for connection to said vacuum hose, and an elongated front wall extending between the front ends of the top, bottom, left and right side walls, said front wall having a plurality of openings communicating with the interior of the housing to provide a front suction surface for engaging drapery material, a portion of said elongated front wall and corresponding extending portions of said top and bottom walls intermediate the front ends of said side walls defining a cut-out; and (b) insert receiving means secured in said cut-out for mounting in operative position different inserts whereby a first insert can be received in said insert receiving means, with a front wall portion flush with said elongated front wall on either side of said cut-out and with openings positioned to provide continuity with the openings in said front wall to define a continuous suction surface between the front ends of the left and right side walls for efficient cleaning of depending drapery material; or whereby a second insert can be received in said insert receiving means with an undulating front wall portion defining transverse fins with channels therebetween, the side walls and front tips of the fins, and floors of the channels having openings connecting with the interior of the housing, so that pleated portions of drapes may be received in said channels between the fins and end channel walls to enable the pleat surfaces and inner folds of the pleats to be subject to suction and thereby cleaned while portions of the drapes on either side of the pleated material are cleaned by the portions of the elongated front wall on either side of said cut-out.

2. A tool head assembly according to claim 1, in which said insert receiving means includes opposed spaced surfaces having inwardly projecting keys with spring biased ball means therein whereby inserts with cooperating key ways and detent means can be removed and replaced manually.

3. A tool head assembly according to claim 1, in which the elongated extent of said insert receiving means is between one fifth and one half the overall distance between the front ends of the left and right side walls of said housing defining the opposite ends of said elongated suction surface.

4. A tool head assembly according to claim 1 in which said plurality of openings comprises two adjacent off-set parallel rows of openings, the dimensions of the openings as measured in the direction of elongation of said suction surface being greater than the spacing between successive openings so that the openings in one row overlap the openings in the adjacent parallel row to assure that all the surface area of a drapery is clean when the tool head suction surface is moved in a direction at right angles to the direction of elongation of said suction surface.

5. A drapery and drapery pleat cleaning tool head for connection to a vacuum hose extending from a cleaning machine, said tool head including, in combination:

(a) a housing comprised of wide front ended top and bottom walls spaced relatively close together with left and right side walls converging towards each other in a rearward direction to merge with narrowed rear end portions of said top and bottom walls into a cylindrical portion having a rear end opening for connection to said vacuum hose, (b) an elongated front wall extending between the front ends of the top, bottom, left and right side walls, (c) said front wall having a plurality of openings communicating with the interior of the housing to provide a front suction surface for engaging drapery material, and (d) a portion of said elongated front wall and corresponding extending portions of said top and bottom walls intermediate the front ends of said side walls defining a cut-out whereby a first insert can be received in said cut-out with a front wall portion flush with said elongated front wall on either side of said cut-out and with openings positioned to provide continuity with the openings in said front wall and a continuous suction surface between the front ends of the left and right side walls for efficient cleaning of depending drapery material or whereby a second insert can be received in said cut-out with an undulating front wall portion defining transverse fins with channels therebetween, the side walls and front tips of the fins, and floors of the channels having openings connecting with the interior of the housing, so that pleated portions of drapes may be received in the channels between the fins and end channel walls to enable the pleat surfaces and inner folds of the pleats to be subject to suction and thereby cleaned while portions of the drapes on either side of the pleated material are cleaned by the portions of the elongated front wall on either side of said cut-out.

6. A drapery and drapery pleat cleaning tool head assembly for use with a vacuum source, said head assembly including a housing having a front wall with a plurality of front openings to define a suction surface, said front wall having means for mounting in operative position any one of a plurality of inserts having different work face configurations for cleaning differently configured work surfaces.

* * * * *